United States Patent [19]

Ping

[11] Patent Number: 4,615,735

[45] Date of Patent: Oct. 7, 1986

[54] ISOSTATIC COMPRESSION TECHNIQUE FOR POWDER METALLURGY

[75] Inventor: Steven W. Ping, Pleasanton, Calif.

[73] Assignee: Kaiser Aluminum & Chemical Corporation, Oakland, Calif.

[21] Appl. No.: 651,723

[22] Filed: Sep. 18, 1984

[51] Int. Cl.[4] ..... C22C 1/00

[52] U.S. Cl. ..... 75/249; 419/31; 419/42; 419/44; 419/53; 419/54; 419/55; 419/49; 419/63; 419/67; 419/68; 420/528; 420/540; 420/541; 420/542; 420/547; 420/548; 420/550

[58] Field of Search ..... 75/249; 420/528, 540, 420/541, 542, 547, 548, 550; 419/31, 42, 44, 53, 54, 55, 49, 63, 67, 68

[56] References Cited

U.S. PATENT DOCUMENTS

| | | | |
|---|---|---|---|
| 3,954,458 | 5/1976 | Roberts | 75/200 |
| 4,063,940 | 12/1977 | Dain et al. | 419/60 |
| 4,104,061 | 8/1978 | Roberts | 75/211 |
| 4,435,213 | 3/1984 | Hildeman et al. | 75/249 |
| 4,587,096 | 5/1986 | Mankins et al. | 419/60 |

*Primary Examiner*—Stephen J. Lechert, Jr.
*Attorney, Agent, or Firm*—Malcolm McQuarrie

[57] ABSTRACT

Powder metallurgy products of high tensile strength are formed in a pore-free state by a novel process which entirely avoids the use of canisters. An open-pore specimen is purged with depurative gas, backfilled with a reactive gas and, while still immersed in the reactive gas, compressed isostatically to an extent necessary to close the pores. The specimen may then be compressed to full density without the need for either high vacuum or a depurative or reactive gas atmosphere.

22 Claims, No Drawings

ISOSTATIC COMPRESSION TECHNIQUE FOR POWDER METALLURGY

BACKGROUND OF THE INVENTION

1. Field of the Invention

This invention relates to the preparation of metal alloy products by powder metallurgy techniques.

2. Description of the Prior Art

The technique of alloying metals by powder metallurgy has provided a major advance in the manufacture of high performance metals, particularly aluminum-based metals. According to this well known process, a powder or particulate is formed by any of the wide variety of known techniques such as, for example, atomization of various types and rapid solidification technology including ribbon and splat techniques. In general, the particles are formed at such a fast rate that coarse constituents or dispersoids do not have a chance to segregate from the crystal structure. The result is a solid solution containing alloying elements in quantities well above those achievable in products cast in ingots. Consequently, unusually favorable corrosion resistance properties as well as mechanical and other properties are achieved.

Part of the overall process involves the transformation of the powders into solid billets which are capable of being worked and formed as needed in conventional metals processing. Exposure to elevated temperatures during this transformation is generally avoided in an attempt to avoid changes in the crystal structure and attendant losses of superior properties. Porosity must be minimized as well since gas-filled pockets in the final product degrade such properties as toughness, fatigue resistance, ductility, stress corrosion resistance and weld quality.

Porosity in the ultimate product occurs in two ways—by the entrapment of inert gases originally surrounding the powder particles upon closure of the pores, and by the generation of gases during the reaction of certain molecular species with the metal during the processing steps. An example of the latter is chemisorbed and physically bound water at the crystal surfaces reacting with the metal to form a solid oxide, leaving gaseous hydrogen as a by-product.

Accordingly, various procedures have been developed for the removal of pore-forming species from partially compacted ("green") specimens prior to compaction of the specimens to full density.

The process disclosed in Roberts, U.S. Pat. No. 3,954,458 (May 4, 1976) is directed to aluminum alloys specifically, and offers a solution which involves the use of a high vacuum (less than $10^{-3}$ torr) at moderate temperature (450°–850° F.), rather than a moderate vacuum at high temperature (900°–1050° F.). The high vacuum disclosed in this reference requires placing the green compacts in welded aluminum canisters. According to the disclosure, isostatic compaction is used to prepare the green compacts before placement in the canisters. Once a compact is in the canister, the high vacuum is drawn (at the moderate temperature) and the canister is sealed to retain the vacuum. Compaction to full density is then achieved by crushing the entire canister with compact sealed inside at a pressure of 133 ksi. The canister must then be removed by scalping. Both the canning and scalping processes are labor-intensive and therefore costly.

An improvement over this process is disclosed in Roberts, U.S. Pat. No. 4,104,061 (Aug. 1, 1978). This improvement is directed to powder metallurgy alloys in general, and it addresses the length of time required for the degassing step, as well as the danger of porosity regeneration in the compacted product during subsequent exposure to high temperatures. The improvement involves the purging of the green compact with a "depurative" gas prior to final compaction. A depurative gas is one which mixes with volatilized species originally bound to the surface of the metal (such as water molecules), and thereby helps remove or "wash" the volatile contaminants out of the green compact during subsequent evacuation. The preferred such gases are those which also react with either the metal matrix or the alloying elements during the final densification or working to produce reaction products which are entirely solid. Accordingly, these preferred gases are commonly referred to as reactive gases. In order to minimize the amount of these reaction products present in the ultimate product, the reactive gas is still evacuated at moderate vacuum according to this disclosure, requiring the use of the canister as before. Therefore, while this disclosure provides improvements in both processing time and ultimate product stability, the expense of the canisters and their removal is still present.

An alternative method of removing pore-forming species is disclosed in Hildeman et al., U.S. Pat. No. 4,435,213 (March 6, 1984). This disclosure is directed to the removal of chemically bonded water molecules from a green compact. Rather than heating the compact under a high vacuum, the process uses rapid induction heating. Even then, however, the process is only of use where toughness is not a concern. For maximum toughness, the patentees state that evacuation of the green compact is still needed.

In all cases, the green compact is formed by isostatic compression of the powder at ambient temperature prior to removal of the pore-forming species. Such removal is achieved by the use of high temperature and high vacuum for prolonged periods, the combination of moderate temperatures, moderate vacuum and depurative gas for shorter periods, or the use of induction heating whether under vacuum or not. Isostatic compression is done primarily for ease of handling, and generally stops short of sealing off the internal pores, leaving a free passage from the pores to the exterior of the compact to permit the escape of gases. Either induction heating or high vacuum degassing in sealed canisters is then used to minimize both porosity and the amount of solid reaction product in the ultimate product. For maximum tensile properties, final compression to full density is then done on these open pore compacts while the latter are still under high vacuum.

SUMMARY OF THE INVENTION

It has now been discovered that tensile properties at least as favorable as those found in the processes described above are achieved by a novel process in which an open-pore specimen is purged with a depurative gas, then backfilled with a reactive gas and, while still immersed in the reactive gas, compressed isostatically to close the pores without the need for ultra high vacuum. This is followed by compressing the specimen to full density without the need for either vacuum conditions or a depurative gas atmosphere. In the preferred practice of the invention, the depurative gas is itself a reactive gas, and most conveniently, the same as that used for the backfilling.

For high tensile strength materials, isostatic compression has heretofore been done to a maximum of about 80% full density in order to provide a green compact with pores which are interconnecting and open to the exterior. In the process of the present invention, however, the isostatic compression is done as a step subsequent to the reactive gas treatment, and to the extent of closing the specimen pores, thus requiring a higher degree of compression. This novel process completely avoids the need for canisters and the ultra high vacuums that are normally used in connection therewith. Unexpectedly, no loss of tensile properties occurs, and the advantages of isostatic compression as a replacement for canister usage are made available. These advantages include the efficient multidirectional use of the compression force and the ease and low cost of the container removal once the compression step has been performed.

DESCRIPTION OF THE PREFERRED EMBODIMENTS

The isostatic compression which forms part of the present invention is done according to conventional procedures. These generally involve sealing the specimen in a flexible bag, typically rubber or plastic, submerging the bag in a hydraulic medium, and applying pressure to the medium which in turn transmits it through the bag to the specimen in all directions. The bag and compact are then extracted from the medium and the compact is removed from the bag. The two are readily separated without the need for machining.

The degree of compaction is not critical provided that substantially all of the pores have been closed off from the exterior of the specimen. In most cases, this is achieved at about 85% to about 99% full density, preferably from about 92% to about 99%, as may readily be determined by simple density measurements. Metallographic examination of the compact may be used to confirm that the pores are closed. Compaction is generally done without the use of externally applied heat, preferably at temperatures below 200° F. (93° C.), and most preferably at ambient temperature. In contrast with hot compaction processes which are done at considerably higher temperatures, this procedure is commonly referred to as "cold isostatic compression."

Although the depurative gas remaining in the closed pores will be consumed by one or more of the metals in the alloy during subsequent compaction to full density, it is generally preferable to minimize the quantity of gas in the pores before the pore-closing isostatic compression takes place. This in turn minimizes the amount of solid reaction product formed, as well as the resistance of the specimen to the compression. Thus, the pressure in the compression bag is lowered below atmospheric before the bag is sealed. This also creates a snug fit of the bag around the specimen so that all external surfaces of the specimen receive the full force of the compression.

One of the major discoveries of the present invention is that high vacuums such as those used in canister processes are not needed. This enables the process of the invention to be conducted using conventional isostatic compression equipment which is generally incapable of accommodating the high vacuums generally used in canister processes. In aluminum processing in particular, it has been found that favorable properties are achieved with vacuums as low as 0.1 torr (absolute pressure) and higher. In preferred practice, the pressure inside the compression bas is 0.5 torr and above. With such moderately reduced pressures inside the compression bag, the pressure of the hydraulic medium operating to compress the bag and the specimen contained therein is generally moderate. In most applications, a compression pressure ranging from about 40 to about 100 ksi ($2.8\times10^4$ to $6.8\times10^4$ newtons/cm$^2$) will produce excellent results.

The purging step which precedes the pore-closing compression is done with a depurative gas to enhance the removal of bound species at the surface of the crystal structure, by dilution of the species vapor in the surrounding atmosphere. In most cases, particularly aluminum, the bound species of greatest concern is water. Accordingly, the depurative gas for these cases is any dry gas. To facilitate the overall procedure, the dry gas is preferably also a reactive gas as described in Roberts, U.S. Pat. No. 4,104,061 (Aug. 1, 1978), incorporated herein by reference.

The form of the specimen during the purging procedure is not critical provided that substantially all surfaces are open to provide access to the exterior. The specimen may thus be either in powder form, or compacted to the form of an open-pore billet. The latter is particularly convenient for handling purposes. The formation of such a billet is readily achieved by cold isostatic compression to a maximum of about 80% of full density, preferably from about 50% to about 80%.

As mentioned in Roberts, the object of the purging step is to remove all water (or any other volatile species) from the surface of the metal. This is a particularly acute problem in aluminum since water chemically binds to aluminum oxide more strongly than it does to most other metals or metal oxides. In preferred embodiments, therefore, the purging involves the use of low pressures and elevated temperatures. The elevated temperature further serves to anneal the alloy, permitting a significant degree of cold work to take place during the pore-closing isostatic compression which follows. To achieve products of optimum properties, of course, the elevated temperature and the length of time during which it is maintained should be controlled in order to avoid substantial segregation of the alloying elements into coarse second phase constituents or dispersoids.

The purging is preferably done by a series of evacuations alternating with gas infusion (or "back filling") steps. In the infusion steps, the powder or open-pore compact is infused with the dry or depurative gas, whereas in the evacuation steps the pressure is lowered to below about $5\times10^{-2}$ torr, preferably below about $1\times10^{-2}$ torr. In typical practice, each cycle lasts from about 5 minutes to about 60 minutes, and at least two cycles are performed, preferably 3 to 15. It is further preferred to use successively lower evacuation pressures in each cycle. When elevated temperatures are used, they will range from about 400° F. (205° C.) up to just below the melting point of the alloy. In aluminum processing, the temperature may range from about 400° F. to about 1050° F. (205° C. to 565° C.), preferably from about 500° F. to about 900° F. (250° C. to 482° C.).

Following the last evacuation-infusion cycle, the specimen is immersed in a reactive gas. In preferred embodiments, of course, this is the same gas as that used for purging. The last infusion step thus serves this immersion function. The reactive gas itself may be a single species or a mixture of species, provided only that all species present will react with one or more of the metals in the alloy at the conditions under which the specimen will subsequently be worked to form solid products with no gaseous by-products. Examples of species meeting this description are nitrogen, oxygen, carbon dioxide, carbon monoxide, tetrafluoromethane, dry air, and fluorine. Nitrogen, oxygen and dry air are preferred. A general description of reactive gas purging is offered by Roberts, U.S. Pat. No. 4,104,061, referenced above.

Once the pore-closing compression step has been completed, the billet may be further compacted to full density so that it may be subsequently worked and formed as a high performance metal. It is not necessary to perform this compaction under vacuum conditions, although for efficiency purposes it is preferably done at elevated temperature. For aluminum manufacture, best results will be obtained at temperatures in excess of about 400° F. (205° C.), most preferably from about 500° F. to about 1000° F. (250° C. to 538° C.). This compaction may be done by rolling, forging, extruding, or any other known means of reducing a metallic billet. The properties of the ultimate product will be improved even more, however, if the products formed by the reaction between the depurative gas and the metal are broken up and redistributed throughout the core of the article by mechanical working. Thus, full density compaction is preferably achieved by a combination of hot pressing and extrusion at high ratios, preferably at least about 6:1, most preferably at least about 12:1.

The product then can be further processed according to conventional techniques to achieve the temper and configuration desired for its ultimate use. These include aging at various temperatures and for various times, working in a variety of ways, and conventional methods of forming.

As stated above, this invention finds particular utility in aluminum-based alloys. Examples include aluminum-iron alloys (notably those further containing cesium, nickel, molybdenum, or combinations of these), aluminum-lithium alloys (notably those further containing copper, magnesium or both), aluminum-zinc alloys (notably those further containing copper, magnesium or both), aluminum-manganese alloys, aluminum-magnesium alloys, and aluminum-silicon alloys. This invention also finds utility in aluminum-base alloys reinforced with nonmetallic discontinuous fibers and particulates as in metal matrix composites.

The following examples are offered for illustrative purposes only and are intended neither to define nor limit the invention in any manner.

EXAMPLE 1

An aluminum alloy powder of the following composition was prepared according to conventional powder metallurgy techniques:

| Element | Weight Percent |
|---|---|
| Zn | 7.0 |
| Mg | 2.3 |
| Cu | 2.0 |
| Zr | 0.20 |
| Co | 0.20 |
| Cr | 0.10 |
| Fe | <0.1 |
| Si | <0.1 |

The powder was classified to achieve a size range of −100 to +325 mesh (U.S. Sieve Series), then placed inside a rubber bag and compressed isostatically in hydraulic medium at 30,000 pounds per square inch (30 ksi; $2.1\times10^4$ newtons/cm$^2$) to approximately 70% density.

The green compact was then removed from the rubber bag and placed in a vacuum furnace where it was heated to 900° F. (482° C.). In alternating manner, the furnace was evacuated to a pressure of less than $2\times10^{-2}$ torr, then infused with dry helium gas. This procedure was repeated eight times, each cycle lasting about twenty minutes. After the final evacuation, the furnace was backfilled with dry nitrogen gas to ambient pressure and permitted to cool to ambient temperature.

The compact was then removed from the furnace and placed in a rubber bag. The bag was then evacuated to a pressure of about 0.5 torr, sealed and compressed at 50 ksi ($3.5\times10^4$ newtons/cm$^2$) to a density of 95%. The compact was then induction heated to 900° F. (482° C.) for 0.12 hour and hot compacted to full density in an extrusion press against a blind die using 80 ksi pressure. The blind die was then replaced by a rectangular die to provide an extrusion ratio of 11.5:1, and the compact was extruded through this die at 690° F. (365° C.).

Cut lengths of the extrusion were solution heat-treated at 925° F. (496° C.) for one hour, then quenched in cold water, stretched 1.5%, aged naturally for five days, aged at 250° F. (121° C.) for 24 hours, then aged at 325° F. (163° C.) for ten hours or thirteen hours to obtain tempers approximating −T76 and −T73, respectively. Tensile properties were then determined according to conventional methods, and compared with those of same temper products formed from the same alloy by conventional procedures (i.e., after the isostatic compaction to 70% density, the compact was placed in a sealed aluminum canister, run through a series of purged cycles as above over a period of eight hours, ending with a pressure of less than $5\times10^{-3}$ torr, then compresed to full density at this pressure while still in the canister). The extrusion ratio used on the conventional product was 17:1. The results, in terms of ultimate tensile strength, yield strength, and elongation of the extruded rectangular bars in two directions, are shown below.

| Method of Preparation | Aging Time (hours) | Direction | UTS (ksi) | YS (ksi) | Elongation (%) |
|---|---|---|---|---|---|
| Present | 10 | L | 93 | 87 | 12 |
| Invention | | LT | 89 | 83.5 | 10 |
| (11.5:1 | 13 | L | 87 | 80 | 12 |
| Extrusion | | LT | 85 | 78 | 10 |
| Ratio) | | | | | |
| Conventional | 10 | L | 95 | 89 | 13 |
| (17:1 | | LT | 90 | 85 | 12 |
| Extrusion | 13 | L | 90 | 82 | 14 |
| Ratio) | | LT | 87 | 80 | 13 |

UTS: Ultimate Tensile Strength
YS: Yield Strength
L: Longitudinal
LT: Long Transverse The data indicates that the tensile properties of the products resulting from the two methods are essentially the same, the small differences in each case reflecting the differences in extrusion ratio rather than the compaction procedure.

The foregoing description is offered primarily for purposes of illustration. It will be readily apparent to those skilled in the art that variations and modifications of the features and procedures described above may still be made without departing from the spirit and scope of the invention, as defined by the claims which follow.

What is claimed is:

1. A method of preparing a metal alloy product from a pre-alloyed powder which comprises:

(a) reducing the pressure of the atmosphere surrounding a specimen comprising said powder or a porous compact thereof having substantially fully interconnecting pores and purging said specimen with a substantially dry gas, while heating said specimen to volatilize bound species from said specimen;

(b) immersing said specimen in a gaseous substance capable of combining with said specimen to form a solid reaction product at elevated temperature and pressure; and (c) compressing said specimen isostatically while immersed in said gaseous substance to form a compact in which substantially all remaining internal void space is comprised of closed discrete pores.

2. A method according to claim 1 in which the specimen of step (a) is a porous compact of from about 50% to about 80% full density having substantially fully interconnecting pores, and is formed by isostatically compressing said powder.

3. A method according to claim 1 further comprising compressing the compact of step (c) to substantially full density at a temperature in excess of about 400° F.

4. A method of preparing an aluminum alloy product from a pre-alloyed aluminum powder which comprises:

(a) reducing the pressure of the atmosphere surrounding a specimen comprising said powder or a porous compact thereof having substantially fully interconnecting pores and purging said specimen with a substantially dry gas, while heating said specimen to volatilize bound species from said specimen;

(b) immersing said specimen in a gaseous substance capable of combining with said specimen to form a solid reaction product at elevated temperature and pressure; and (c) compressing said specimen isostatically while immersed in said gaseous substance to form a compact in which substantially all remaining internal void space is comprised of closed discrete pores.

5. A method according to claim 4 in which the pressure of the gaseous substance in steps (b) and (c) is at least about 0.1 torr.

6. A method according to claim 4 in which the pressure of the gaseous substance in steps (b) and (c) is at least about 0.5 torr.

7. A method according to claim 4 in which the compact of step (c) has a density of from about 85% to about 99% of full density, and said method further comprises compressing said compact to substantially full density at a temperature of from about 400° F. to about 1200° F.

8. A method according to claim 4 in which the compact of step (c) has a density of from about 92% to about 99% full density, and said method further comprises compressing said compact to substantially full density at a temperature of from about 500° F. to about 1000° F.

9. A method according to claim 4 in which the specimen of step (a) is a porous compact of from about 50% to about 80% full density having substantially fully interconnecting pores, and is formed by isostatically compressing said powder.

10. A method according to claim 4 in which step (c) is performed at a temperature of less than about 200° F.

11. A method according to claim 4 in which step (c) is performed at approximately ambient temperature.

12. A method according to claim 4 in which the pressure reduction and purge of step (a) are performed in alternating sequence at least twice at elevated temperature.

13. A method according to claim 4 in which the pressure reduction and purge of step (a) are performed in alternating sequence at least twice at a temperature ranging from about 400° F. to about 1050° F. and said pressure reduction is performed to achieve a pressure of below about $5\times10^{-2}$ torr.

14. A method according to claim 4 in which the pressure reduction and purge of step (a) are performed in alternating sequence at least twice at a temperature ranging from about 500° F. to about 900° F. and said pressure reduction is performed to achieve a pressure of below about $1\times10^{-2}$ torr.

15. A method according to claim 4 in which the dry gas of step (a) and the gaseous substance of steps (b) and (c) are the same and are at least one member selected from the group consisting of nitrogen, oxygen, carbon dioxide, carbon monoxide, tetrafluoromethane, dry air, and fluorine.

16. A method according to claim 4 in which the dry gas of step (a) and the gaseous substance of steps (b) and (c) are the same and are selected from the group consisting of nitrogen, oxygen and dry air.

17. A method of preparing an aluminum alloy product from a pre-alloyed aluminum powder which comprises: (a) compressing said powder isostatically to form a porous compact of about 50% to about 80% full density having substantially fully interconnecting pores;

(b) alternately reducing the pressure of the atmosphere surrounding said compact and purging said compact with a gaseous substance capable of combining with said specimen to form a solid reaction product, while heating said compact to a temperature ranging from about 400° F. to about 1050° F.;

(c) repeating step (b) at least twice to volatilize and remove substantially all bound species from said specimen, concluding with a pressure of at least about 0.5 torr;

(d) compressing said compact isostatically at a temperature of less than about 200° F. to form a compact of about 85% to about 99% full density in which substantially all remaining internal void space is comprised of closed discrete pores; and (e) compressing the product of step (d) to substantially full density at a temperature of from about 500° F. to about 900° F.

18. A method according to claim 17 in which the compression force of step (d) is from about 40 ksi to about 100 ksi.

19. A method according to claim 17 in which the gaseous substance of step (b) is selected from the group consisting of nitrogen, oxygen, and dry air.

20. A method according to claim 17 in which the pressure in step (d) is approximately atmospheric.

21. An aluminum alloy product prepared by the method of claim 4.

22. An aluminum alloy product prepared by the method of claim 17.

* * * * *